US006592014B2

(12) United States Patent
Smolinski

(10) Patent No.: US 6,592,014 B2
(45) Date of Patent: Jul. 15, 2003

(54) LOCKOUT MECHANISM FOR FASTENER DRIVING TOOL

(75) Inventor: Darek Smolinski, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 12 days.

(21) Appl. No.: 10/017,646

(22) Filed: Dec. 13, 2001

(65) Prior Publication Data

US 2003/0111239 A1 Jun. 19, 2003

(51) Int. Cl.[7] ..... B25C 1/04
(52) U.S. Cl. ..... 227/8; 227/130
(58) Field of Search ..... 227/130, 120, 227/136, 8

(56) References Cited

U.S. PATENT DOCUMENTS 3,198,412 A * 8/1965 Roosa ..... 227/8
3,563,438 A * 2/1971 Doyle ..... 227/130
3,606,128 A * 9/1971 Cast et al. ..... 227/130
4,197,974 A * 4/1980 Morton et al. ..... 227/120
4,597,517 A 7/1986 Wagdy
5,180,091 A 1/1993 Ota
5,816,468 A 10/1998 Yang
6,012,622 A 1/2000 Weinger et al.
6,056,181 A * 5/2000 Chuang ..... 227/8
6,149,046 A 11/2000 Ho et al.
6,173,877 B1 1/2001 Wingert
6,199,739 B1 3/2001 Mukoyama et al.
6,296,167 B1 * 10/2001 Jen ..... 227/120

* cited by examiner

*Primary Examiner*—Scott A. Smith
(74) *Attorney, Agent, or Firm*—Lisa M. Soltis; Mark W. Croll; Donald J. Breh

(57) ABSTRACT

A lockout mechanism for a fastener driving tool having a magazine for storing and sequentially urging fasteners toward a nosepiece through which a driver blade impacts and drives the fasteners into a workpiece, the lockout mechanism is configured for preventing the firing of the fastener driving tool when the magazine is empty or nearly empty of fasteners. A fastener track is defined in the magazine for the passage of the fasteners toward the nosepiece. A biased follower urges the fasteners in the fastener track toward the nosepiece. The fastener track has a bypass portion dimensioned for receiving the follower whereby upon reaching the bypass portion, the follower becomes disengaged from the fasteners and moves into engagement with the nosepiece for preventing operation of the tool. The bypass portion is located near a magazine driving end to indicate when the magazine is empty or nearly empty.

11 Claims, 4 Drawing Sheets

Fig. 5
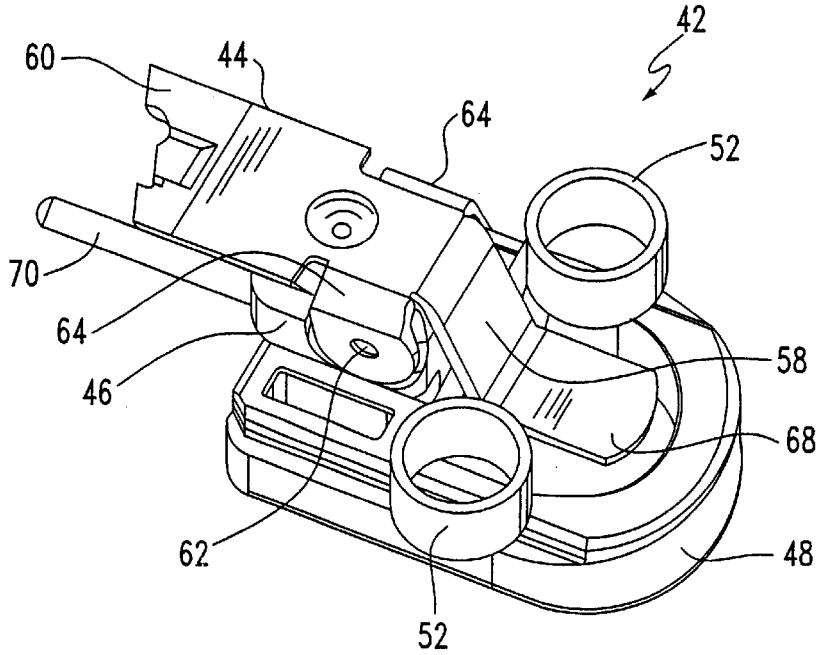
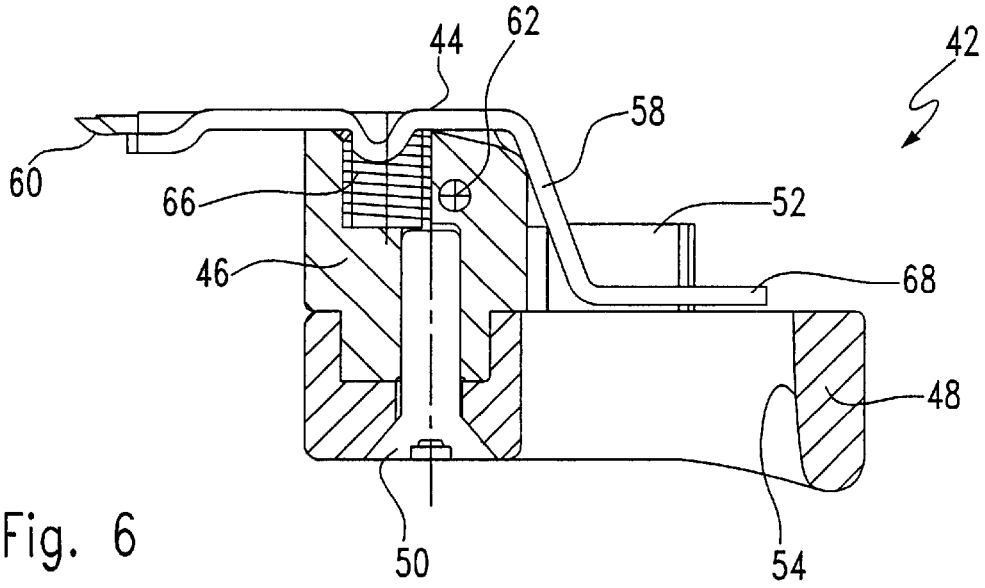
Fig. 6

LOCKOUT MECHANISM FOR FASTENER DRIVING TOOL

BACKGROUND OF THE INVENTION

The present invention relates to fastener-driving tools which are typically powered by combustion, pneumatics, electricity or powder. In such tools, a plurality of fasteners are sequentially arranged in a magazine and are urged by a biased follower toward a driving end of the magazine where the fasteners are each pushed into a nosepiece. Once in the nosepiece, the fasteners are driven into a workpiece by a reciprocating driver blade.

A design criterion of most such tools is that the driving blade should be immobilized when the magazine is empty of fasteners. So-called "dry firing" can damage the workpiece or the tool itself Indicator mechanisms are known in such tools to indicate to the user when the magazine is empty or almost empty, so that the magazine can be refilled prior to a dry firing condition. In some of these known mechanisms, the driver blade is locked when the magazine is empty to prevent dry firing.

The issue of prevention of dry firing is particularly challenging when the fasteners are finish nails, which typically are provided in stamped strips. The problems associated with driving such fasteners are described in commonly-assigned U.S. Pat. No. 6,176,412 which is incorporated by reference. Each fastener is relatively thin, and as the fasteners become smaller, they also become thinner. This reduced thickness results in a relatively small increment of movement of the follower upon the driving of each fastener. Thus, it is difficult to design a tool to precisely monitor a fixed number of remaining fasteners to indicate when the magazine needs refilling. This problem is exacerbated by the fact that a given fastener-driving tool is often designed to accommodate a variety of fastener sizes. If, for example, the tool is designed so that a visual, audible or tactile warning is generated upon there being only ten fasteners left in the magazine, the location of the end of the particular strip of fasteners will vary with the size of the fastener. When very thin fasteners are used, such as small finish nails, the combined length of the ten fasteners may be insufficient to reliably enable a warning system to warn the user in time to prevent dry firing.

Thus, it is a first object of the present invention to provide an improved lockout mechanism for a fastener-driving tool which prevents dry firing for a variety of fastener sizes.

Another object of the present invention is to provide an improved lockout mechanism which triggers the lockout function through a mechanical magnification of the significance of a single fastener thickness.

Still another object of the present invention is to provide an improved lockout mechanism which prevents dry firing without requiring additional parts and assembly to the existing tool.

BRIEF SUMMARY OF THE INVENTION

The above-listed objects are met or exceeded by the present lockout mechanism, which features a bypass structure in a fixed position on the magazine near the driver end of the magazine adjacent the nosepiece. Once the number of fasteners in the magazine is reduced so that the follower reaches the bypass structure, the follower becomes disengaged from the remaining fasteners, and moves toward the nosepiece to lock the tool and prevent firing.

More specifically, the present invention provides a lockout mechanism for a fastener-driving tool having a magazine for storing and sequentially urging fasteners toward a nosepiece through which a driver blade impacts and drives the fasteners into a workpiece. The lockout mechanism is configured for preventing the firing of the fastener-driving tool when the magazine is empty or nearly empty of fasteners. A fastener track is defined in the magazine for the passage of the fasteners toward the nosepiece. A biased follower urges the fasteners in the fastener track toward the nosepiece. The fastener track has a bypass portion dimensioned for receiving the follower, whereby upon reaching the bypass portion, the follower becomes disengaged from the fasteners and moves into engagement with the nosepiece for preventing operation of the tool. The bypass portion is located near a magazine driving end to indicate when the magazine is empty or nearly empty.

BRIEF DESCRIPTION OF THE SEVERAL VIEWS OF THE DRAWINGS

FIG. 5 is a reverse perspective elevation of the follower shown in FIG. 3; and FIG. 6 is a section taken along the line 6—6 of FIG. 1 and in the direction indicated generally.

DETAILED DESCRIPTION OF THE INVENTION

Figure 1:
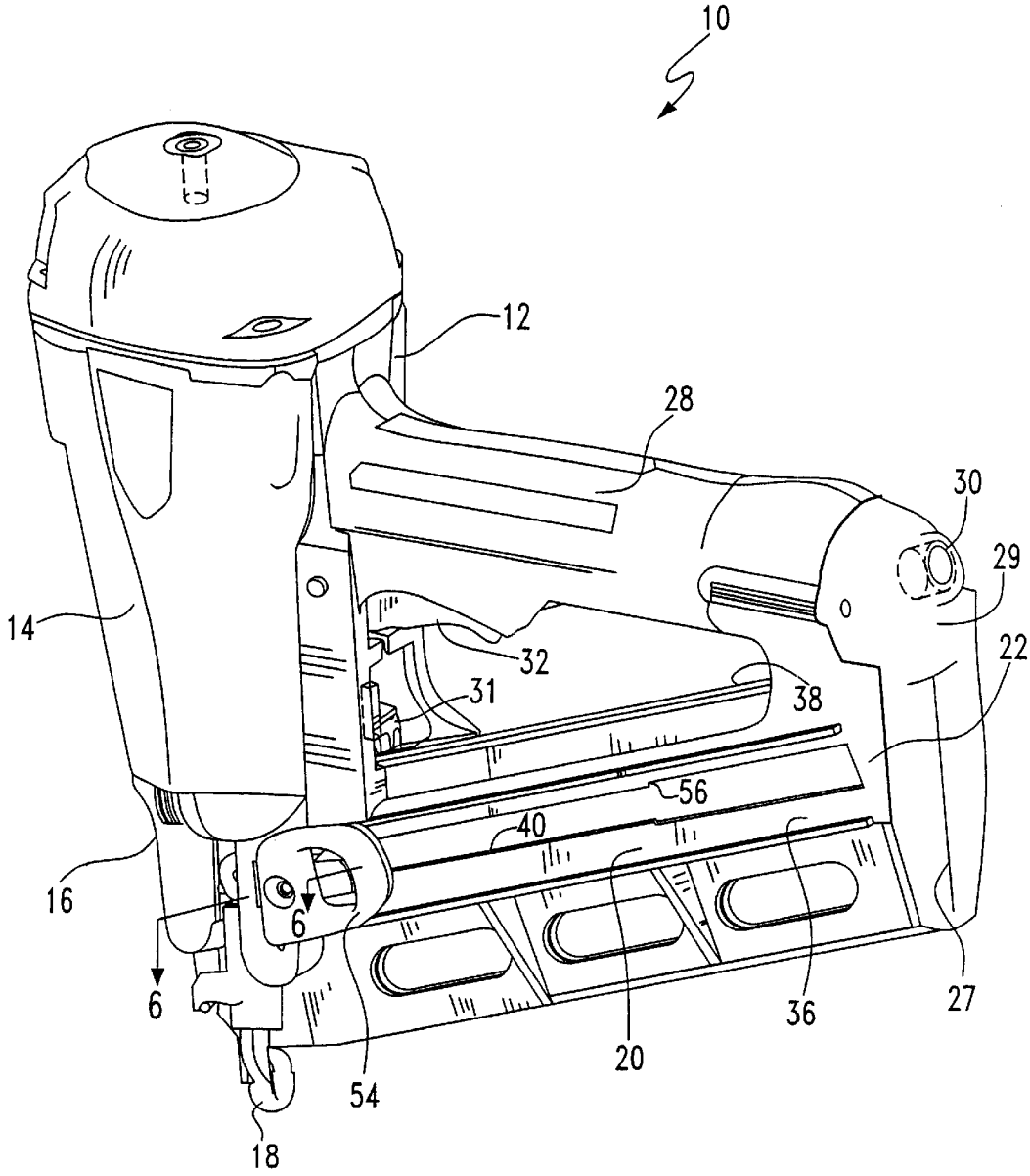
FIG. 1 is a rear perspective elevation of a fastener tool of the type which is suitable for use with the present invention.
Figure 2:
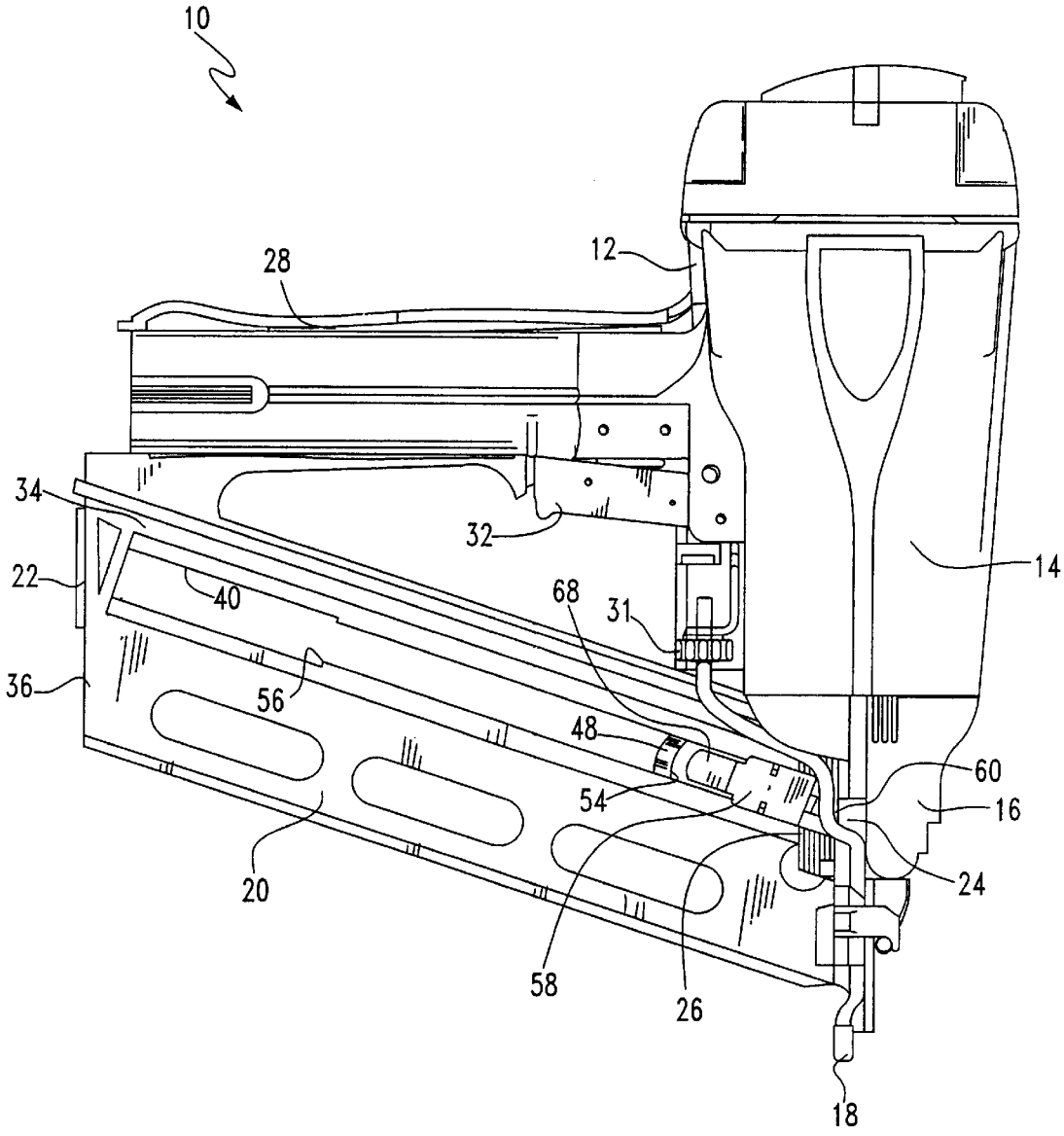
FIG. 2 is a reverse side elevational view of the tool shown in FIG. 1 with portions omitted for clarity.
Figure 3:
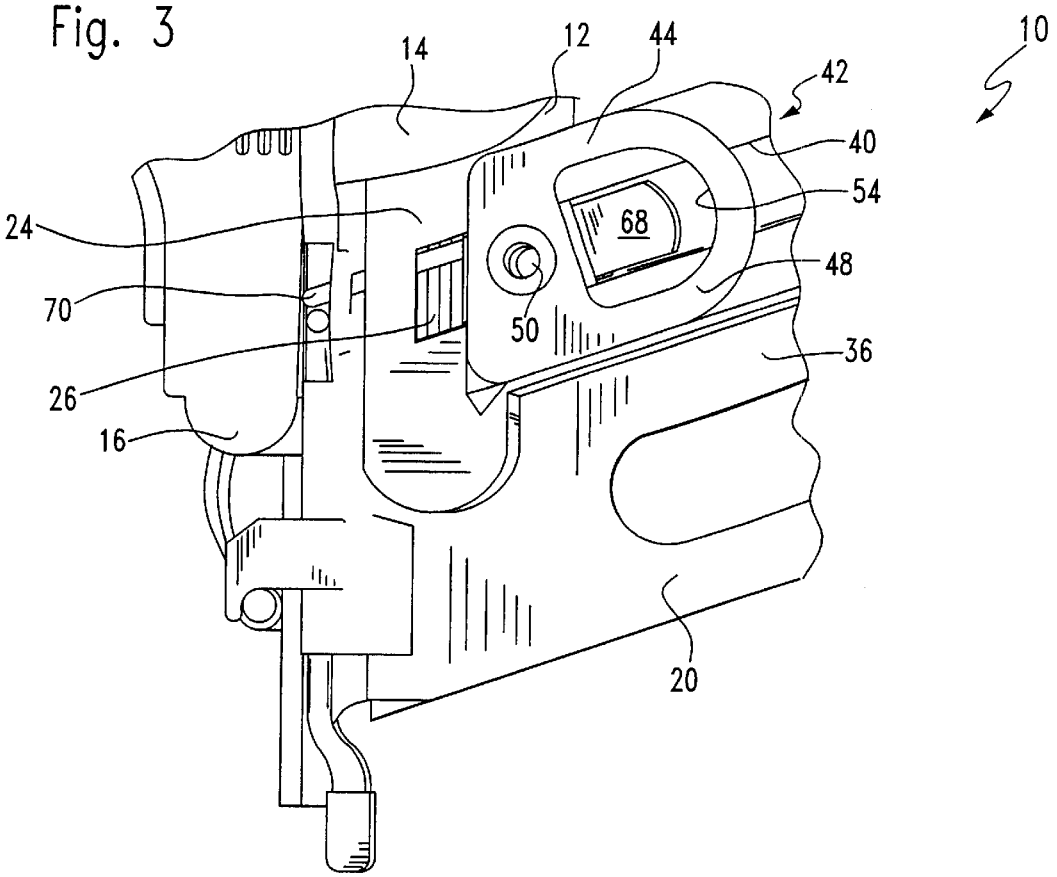
FIG. 3 is an enlarged fragmentary elevational view of the tool of FIG. 1.
Figure 4:
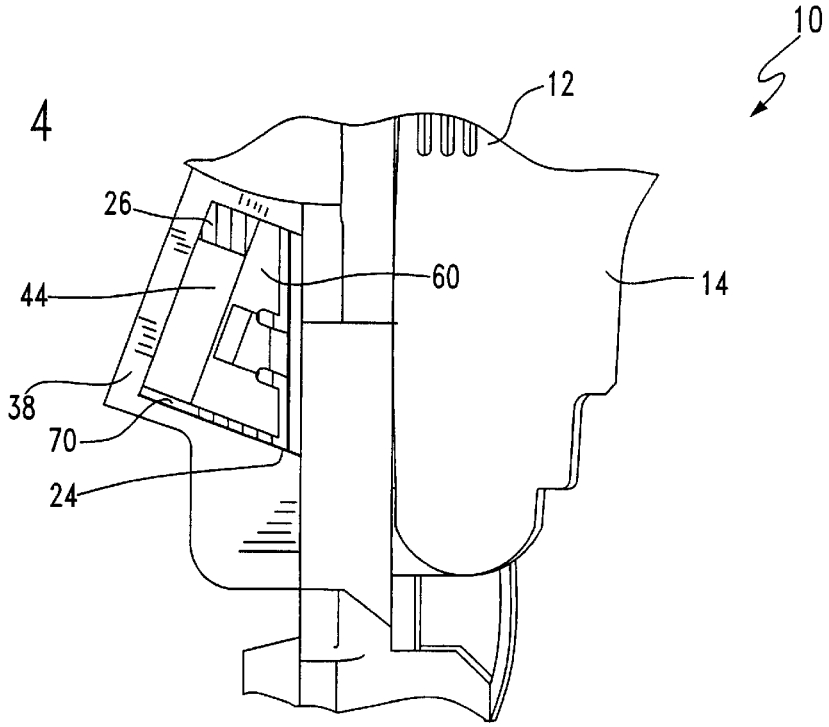
FIG. 4 is an enlarged fragmentary elevational view of the tool of FIG. 2.

Referring now to FIGS. 1 and 2, a fastener-driving tool suitable for use with the present lockout mechanism is generally designated 10. While the tool 10 is depicted as a pneumatic tool, it is contemplated that the present mechanism may be utilized with pneumatic, combustion, powder or electric-powered fastener tools. The tool 10 includes a housing 12 enclosing a fastener driving portion 14 which includes a reciprocating driver blade (not shown) traveling in a track (not shown) ending in a nosepiece 16. As is typical in such tools, the nosepiece 16 includes a workpiece contact element 18 which reciprocates relative to the nosepiece, and moves upwards relative to the nosepiece to enable the firing of the tool. This operation is the same regardless of whether the tool 10 is pneumatic, combustion or powder activated.

A magazine 20 has a feed end 22 and a driving end 24, the latter closer to, and connected to the nosepiece 16 for feeding fasteners 26 (best seen in FIG. 2) contained within the magazine toward the driving blade track. The fasteners 26 are inserted into the magazine 20 at the opposite feed end 22 through a slot 27 as is well known in the art. A handle 28 is connected to the housing between the fastener driving portion 14 and the feed end 22 of the magazine 20. In some embodiments, the handle 28, the magazine 20 and the fastener driving portion 14 of the housing 12 are integrally formed. It is also contemplated to have the handle 28 and the fastener driving portion 14 integrally formed, with the magazine 20 a separate component. In the preferred embodiment, an endcap 29 is provided to assist the fastening of the handle 28 to the magazine 20. In addition, since the tool 10 is depicted as a pneumatic tool, the endcap 29 houses an air inlet 30.

A depth of drive mechanism 31 (best seen in FIG. 2) is provided for adjusting the linear displacement of the workpiece contact element 18 to allow for fasteners of varying lengths, and also provides the capability of partially driving certain fasteners into the workpiece. A trigger 32 is mounted to an underside of the handle 28 for initiating the fastener driving process.

Referring again to the magazine 20, a fastener track 34 is defined for enabling the passage of the fasteners 26 toward the nosepiece 16. The fastener track 34 is partially defined by each of the halves 36, 38 of the magazine. The first magazine half 36 is shown in FIG. 1 as the left side of the tool 10 as it is held by a right-handed user, and features an elongate follower track 40 running almost the full length of the magazine. In FIG. 2, an inside surface of the magazine half 36 is depicted. In the preferred embodiment, the follower track 40 is an elongate opening formed in one of the magazine halves 36, 38 and is adjacent the fastener track 34.

Referring now to FIGS. 3–6, the present lockout assembly, generally designated 42, includes a biased follower 44 for contacting and urging the fasteners 26 in the fastener track 34 toward the nosepiece 16. The follower 44 includes a follower core 46 secured to a follower handle 48, such as by a fastener 50, chemical adhesives, ultrasonic welding or other known fastening technology. The follower core 46 is preferably dimensioned to slidably engage the follower track 40.

A negator spring 52 is also part of the assembly 42 and is connected to the follower 44 to provide the biasing force for urging the follower 44 along the follower track 40 toward the nosepiece 16. As is well known in the art, one end of the negator spring 52 is connected to the magazine 20. A gripping loop 54 is provided in the follower handle 48 for facilitating the pulling of the follower 44 toward the feed end 22. A shoulder or step 56 is formed in the follower track 40 for holding the follower 44 in place while fasteners 26 are inserted into the fastener track 34. Other equivalent devices known in the art are contemplated for temporarily securing the follower 44 in position in the follower track 40.

A follower blade 58 has an angled forward edge 60 oriented to engage the angled fasteners 26 in the fastener track 34, and is pivotally mounted to the follower core 46 by a pin 62 passing through the core and opposing ears 64 on the follower blade 58. A follower spring 66 is preferably located in the follower core 46 and is configured to bias the follower blade 58 laterally in the fastener track 34. The biasing force provided by the follower spring 66 laterally stabilizes the follower 44 stabilized within the fastener track 34. While the follower spring 66 is preferably a coiled compression spring, it is contemplated that other equivalent springs may be employed, as is well known in the art, so that the follower blade 58 is biased in the manner described above.

Opposite the forward edge 60 is a release end 68 on the follower blade 58. Also projecting in the same direction as the follower blade 58 is a lockout pin 70 (best seen in FIGS. 3 and 5). In the preferred embodiment, the lock-out pin 70 has a length which extends substantially beyond a forward edge of the follower core 46 as well as from the forward blade edge 60. The lockout pin 70 preferably has sufficient length and rigidity to engage the path of the workpiece contact element 18 and prevent movement of the element upon depression of the tool 10 toward the work piece as is done prior to firing.

Upon insertion of the fasteners 26, the gripping loop 54 is pulled back toward the feed end 22 to disengage the follower 44 from the step 56, and the negator spring 52 then pulls the follower core 46 into contact with the fasteners 26. Specifically, the forward edge 60 engages the last fastener in the row of fasteners 26.

An important feature of the present invention is a bypass portion dimensioned for receiving the follower 44, whereby upon reaching the bypass portion, the follower becomes disengaged from the fasteners 26 and moves rapidly forward into engagement with the nosepiece 16 for preventing operation of the tool. More specifically, the bypass portion is preferably a window 72 formed in the magazine 20 and positioned far enough from the driving end 24 so that there will be a sufficient number of fasteners remaining in the fastener track 34 to prevent dry firing. While in the preferred embodiment, the window 72 is located in the magazine half 38 which is the opposite half from the location of the follower track 40, it is contemplated that a different arrangement could be provided so that the window is on the magazine half 36.

The window 72 is dimensioned to receive the forward portion of the follower blade 58 as it is pushed laterally out of engagement with the fasteners 26 by the force of the follower spring 66. However, the window 72 is not large enough that the follower blade 58 is pushed totally out of the magazine 20.

Once the follower blade 58 engages the window 72 and is pushed out of engagement with the fasteners 26, the negator spring 52 pulls the follower 44 rapidly along the fastener track 40 toward the driving end 26. The forward edge 60 of the follower blade 58 projects sufficiently forward from the follower core 46 to accommodate the remaining fasteners 26 in the magazine 20 between the core and the edge 60 (best seen in FIG. 2). This length can be adjusted depending on the application and/or the size of the fasteners 26 to be used and the design of the particular tool 10. Thus, despite the fact that relatively thin fasteners are employed in the tool 10, the present lockout mechanism 42 is configured so that the lockout function is triggered through a mechanical magnification of the significance of a single fastener thickness. In other words, once the follower blade 58 incrementally reaches the window 72, the thickness of that last fastener results in the locking of the tool through the rapid forward movement of the follower 44.

The lock-out pin 70 is long enough so that once the follower 44 has reached the forward end of the follower track 40, the lock-out pin projects into the path of the workpiece contact element 18 to prevent any upward movement of the element. With the movement of the workpiece contact element 18 thus blocked, the tool cannot be fired, as is well known in the art. In this manner, the user is alerted to the fact that fasteners need to be added to the magazine 20.

An additional feature of the present lock-out mechanism 42 is that once the follower 44 is disengaged from the fasteners 26 (best seen in FIG. 4), the presence of the follower in the window 72 provides a visual indication to the user that the tool 10 is disabled and there are a limited number of remaining fasteners such that the magazine 20 needs reloading.

To reload the magazine 20, the user presses the release end 68 of the follower blade 58, which pivots the blade out of engagement with the window 70 and the user then pulls back on the pulling loop 54 to retract the follower 44 toward the feed end 22. As described above, the follower 44 may be engaged on the step 56 during the loading process.

While specific embodiments of the lockout mechanism for a fastener driving tool of the present invention have been shown and described, it will be appreciated by those skilled in the art that changes and modifications may be made thereto without departing from the invention in its broader aspects and as set forth in the following claims.

What is claimed is:

1. A lockout mechanism for a fastener driving tool having a magazine configured for storing and sequentially urging fasteners toward a nosepiece through which a driver blade travels to impact and drive the fasteners into a workpiece, said mechanism comprising:

said magazine defining a fastener track for the passage of the fasteners toward the nosepiece, and including a biased follower for urging the fasteners in said fastener track toward said nosepiece; and said fastener track having a bypass portion dimensioned for receiving said follower whereby upon reaching said bypass portion, said follower becomes disengaged from the fasteners and moves into engagement with the nosepiece for preventing operation of the tool.

2. The lockout mechanism of claim 1 wherein said bypass portion is a window in said magazine.

3. The lockout mechanism of claim 2 wherein said window is configured for visually indicating the bypassed condition of said follower.

4. The lockout mechanism of claim 3 wherein said window is located along said fastener track near said nosepiece to indicate a limited number of remaining fasteners in said magazine.

5. The lockout mechanism of claim 1 wherein said follower is provided with a lateral biasing element for maintaining alignment of said follower in said fastener track, and upon reaching said bypass portion, said lateral biasing element laterally urges said follower out of engagement with the fasteners and into said bypass portion.

6. The lockout mechanism of claim 5 further including a negator spring secured to said magazine and connected to said follower for biasing said follower toward said nosepiece.

7. The lockout mechanism of claim 1 further including a pin on said follower, said pin projects toward the nosepiece for engaging and locking the assembly.

8. The lockout mechanism of claim 1 wherein said nosepiece includes a reciprocating workpiece contact element, said pin is configured for preventing movement of the workpiece contact element relative to the tool housing.

9. In a fastener driving tool having a magazine configured for providing a sequence of fasteners to a nosepiece, a lockout mechanism for preventing the firing of the fastener driving tool when said magazine is empty or nearly empty of fasteners, said mechanism comprising:

said magazine having a follower configured for urging the fasteners toward a driving end of said magazine, and a bypass formation located in said magazine near said driving end, said bypass formation being configured so that upon the engagement of said follower in said formation, said follower becomes disengaged from the fasteners and is biased toward said nosepiece to prevent the firing of the tool.

10. The tool of claim 9 wherein said nosepiece includes a reciprocating workpiece contact element, and said lockout mechanism further includes a formation on said follower for preventing the reciprocation of said workpiece contact element.

11. The lockout mechanism of claim 9 wherein said follower is provided with a lateral biasing element for maintaining alignment of said follower in said fastener track, and upon reaching said bypass portion, said lateral biasing element laterally urges said follower out of engagement with the fasteners and into said bypass portion.

* * * * *